United States Patent [19]

Young et al.

[11] Patent Number: 4,646,764

[45] Date of Patent: Mar. 3, 1987

[54] PROCESS FOR PROVIDING ROLL RECONSTITUTED TOBACCO MATERIAL

[75] Inventors: Harvey J. Young, Winston-Salem; Gerard E. Leonard, Kernersville, both of N.C.

[73] Assignee: R. J. Reynolds Tobacco Company, Winston-Salem, N.C.

[21] Appl. No.: 809,456

[22] Filed: Dec. 16, 1985

[51] Int. Cl.[4] ..... A24B 15/12

[52] U.S. Cl. ..... 131/370; 131/353; 131/324

[58] Field of Search ..... 131/370, 358, 324

[56] References Cited

U.S. PATENT DOCUMENTS 1,068,403 7/1913 Maier . .
2,708,175 5/1955 Samfield et al. .
2,845,933 8/1958 Samfield et al. .
3,053,259 9/1962 Parmele et al. .
3,203,432 8/1965 Green et al. .
3,209,763 10/1965 Parmele et al. .
3,865,120 2/1975 Detert et al. .
3,986,515 10/1976 Egri .
4,164,948 8/1979 Beringer et al. .

*Primary Examiner*—V. Millin
*Attorney, Agent, or Firm*—Grover M. Myers

[57] ABSTRACT

A process for reclaiming tobacco comprises providing tobacco material including relatively large fibrous forming tobacco leaf stem material, passing the tobacco through a pressurized roller system, and forming a reclaimed tobacco material under pressure. Tobacco stems, fines, dust and waste can be reconstituted in strand form or sheet-like form using a process which utilizes relatively low amounts of moisture.

27 Claims, 3 Drawing Figures

PROCESS FOR PROVIDING ROLL RECONSTITUTED TOBACCO MATERIAL

BACKGROUND OF THE INVENTION

This invention relates to methods for making tobacco products, and in particular, to methods for making reconstituted tobacco products under conditions of relatively low moisture levels.

When tobacco leaf is processed for use in smoking products and when tobacco products are manufactured, a substantial amount of scrap or waste tobacco is provided. Scrap or waste tobacco can be in the form of tobacco dust (typical particle size is less than about 60 Tyler mesh), tobacco fines (typical particle size is between about 20 Tyler mesh and about 60 Tyler mesh), tobacco stems, or processed tobacco which remains unused after tobacco product manufacture is completed. As scrap or waste tobacco frequently is of high quality, it is highly desirable to reclaim or reconstitute such scrap or waste tobacco. For example, it is desirable to provide reclaimed or reconstituted tobacco in sheet form, and to blend the reclaimed or reconstituted tobacco with tobacco leaf in order to provide cut filler. The resulting cut filler is used in the manufacture of cigarettes.

Various methods for providing reclaimed, reformed, reassembled or reconstituted tobacco are known. For example, tobacco materials can be mixed with relatively large amounts of water, processed, and dried. U.S. Pat. No. 1,068,403 discloses a process for the production of so-called artificial tobacco leaves by which tobacco veins are mixed with water in order to form a pulp, and the pulped veins are further processed. However, the method disclosed in U.S. Pat. No. 1,068,403 requires the use of relatively large amounts of water and undesirable subsequent drying steps.

U.S. Pat. No. 3,053,259, discloses another method for reclaiming tobacco fragments or tobacco fines. For example, tobacco material is ground to a very small size using a hammer mill or ball mill; the ground tobacco is moistened or mixed with a binder; and filamentary shreds are press formed or molded by passing the resulting mixture between a smooth surface roller and a grooved roller. However, the disclosed method requires the use of relatively large amounts of moisture, especially when a binder is not employed.

As there is a need for a process for regenerating tobacco waste products, it would be highly desirable to provide an efficient and effective process for providing reclaimed tobacco in the form of a sheet or in the form of a strand. In particular, it is desirable to provide reclaimed tobacco using a process which requires neither the use of a relatively large amount of water and post drying of product nor the pre-grinding of tobacco material.

SUMMARY OF THE INVENTION

This invention is a process for reclaiming tobacco, said process comprising the steps in combination (a) providing tobacco material including tobacco leaf stem material, the tobacco material having a moisture content less than about 30 weight percent, and then (b) passing the tobacco material through the nip of a first pressurized roller system having two rollers exhibiting a nip zone pressure sufficient to provide compression of said tobacco material thereby providing compressed, admixed tobacco material, wherein at least one of the roller faces comprises a series of grooves extending along the longitudinal axis of the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the tobacco leaf stem material is employed in a structural strength providing amount, and then (c) forming under pressure reclaimed tobacco material by passing the compressed, admixed tobacco material through the nip of a second pressurized roller system having two rollers exhibiting a nip zone pressure sufficient to provide the reclaimed tobacco material, wherein at least one of the roller faces of the rollers comprises a series of grooves extending along the longitudinal axis of the roller and each groove extends about the periphery of the roller, wherein each groove has a maximum width near the surface of the roller and a minimum width near the bottom of the groove, and wherein each of the grooves has a maximum width and depth sufficient to provide reclaimed material, and then (d) removing the reclaimed tobacco material from the face of the roller of the second pressurized roller system, said roller comprising the aforementioned series of grooves.

In another aspect, the present invention is an apparatus for providing reclaimed tobacco, the apparatus comprising (a) a first pressurized roller system wherein at least one of the roller faces thereof comprises a series of grooves extending along the longitudinal axis of the roller wherein each groove extends about the periphery of the roller, and wherein each groove has a maximum width near the surface of the roller and a minimum width near the bottom of the groove, (b) a second pressurized roller system wherein at least one of the roller faces thereof comprises a series of grooves extending along the longitudinal axis of the roller wherein each groove extends about the periphery of the roller, and wherein each groove has a maximum width near the surface of the roller and a minimum width near the bottom of the groove, and (c) a means for removing reclaimed tobacco material from the roller face having the series of grooves of the second pressurized roller system thereby providing reclaimed tobacco which is processed therein.

Surprisingly, the invention allows for the reclamation of tobacco in an efficient and effective manner using a process which requires neither relatively large amounts of moisture nor the necessity of the addition of binders. In fact, the process of this invention can be performed in the absence of binders. The process of this invention can be performed using relatively large pieces of tobacco leaf and leaf stem material, and does not require the pre-grinding of said stem material to a small size. The process of this invention can be performed at or near ambient temperatures without the necessity of the application of external heat. If desired, the process of this invention can be performed without chemical pretreatment of the tobacco.

The reclaimed tobacco material in either strand form or sheet-like form can be employed as is known in the art. For example, the tobacco material provided by the process of this invention can be dried, cut to the desired size, treated with additives, blended with other tobacco products, etc. The resulting reclaimed tobacco material is most useful in the manufacture of cigarettes. Thus, in another aspect, the present invention is a cigarette containing the reclaimed tobacco material prepared according to the process of this invention.

DETAILED DESCRIPTION OF THE EMBODIMENTS

Figure 1:
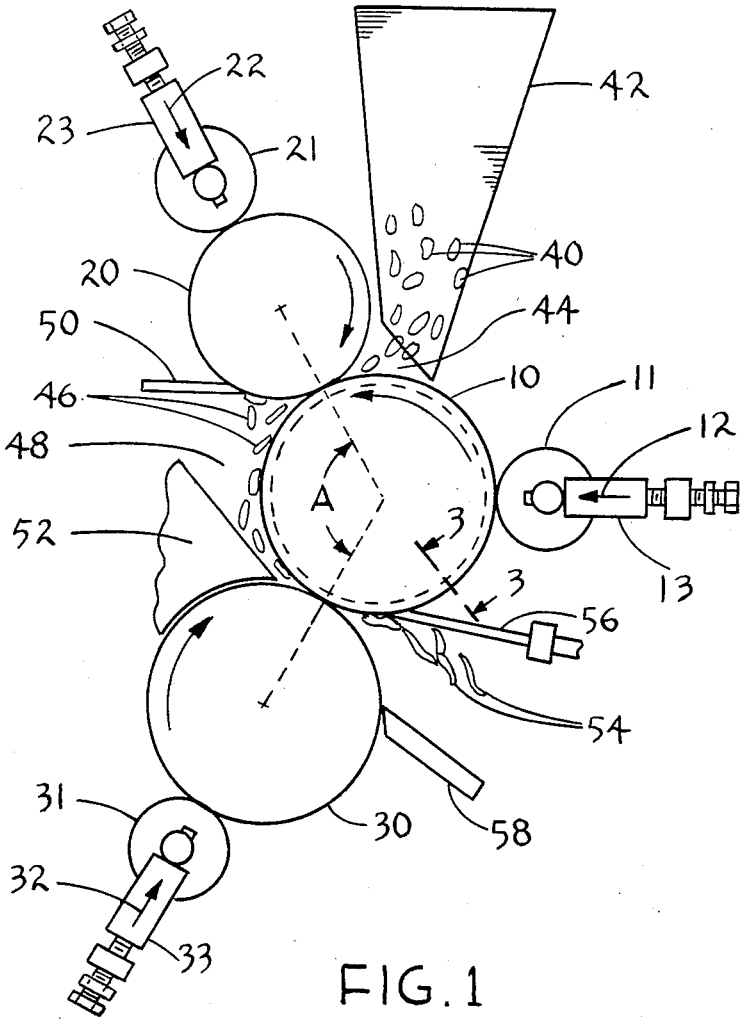
FIG. 1 is a diagrammatic illustration of one embodiment of an apparatus and process of this invention showing the two pressurized roller systems and tobacco material processed to reclaimed strand material.
Figure 2:
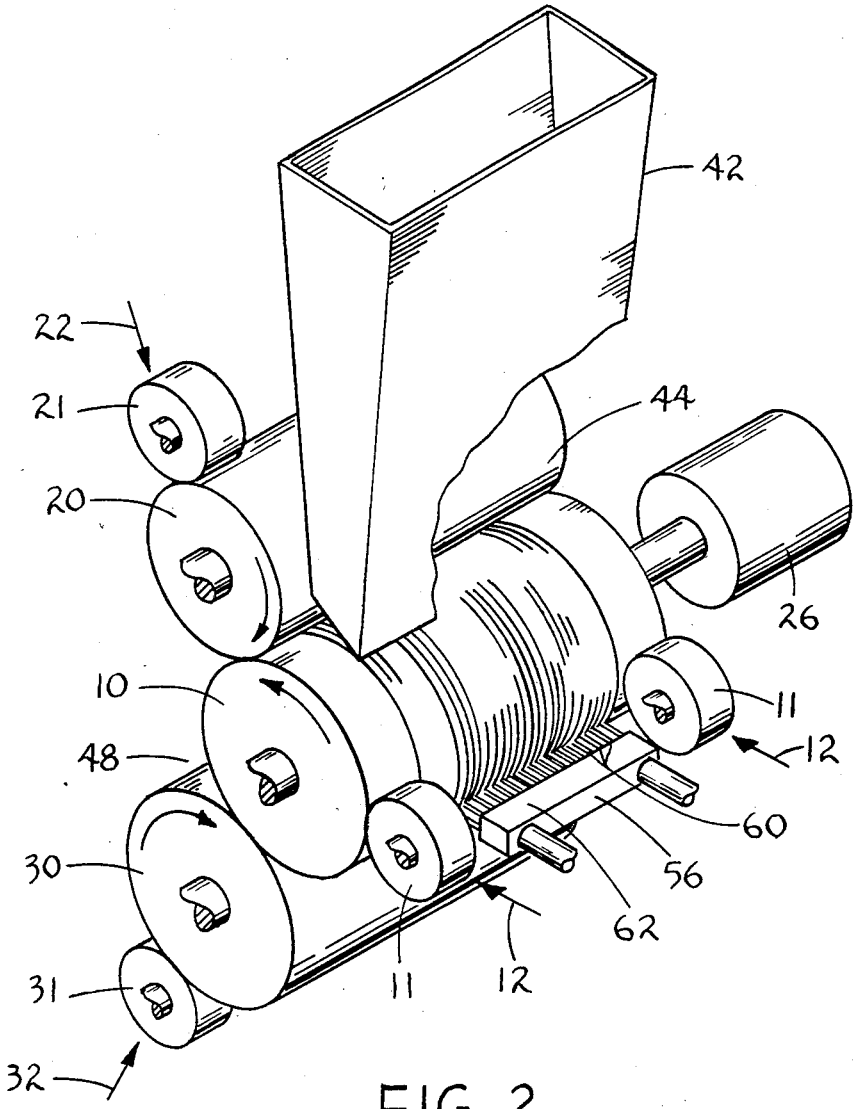
FIG. 2 is a perspective of an apparatus of this invention showing the pressurized roller systems and the means for removing reclaimed tobacco material from the roller face of a roller of the second pressurized roller system.

FIGS. 1 and 2 illustrate an apparatus for conducting the process of this invention. The apparatus comprises a first pressurized roller system and a second pressurized roller system. As used herein, the term "pressurized roller system" means two rollers in roll contact and exhibiting a nip zone pressure sufficient to provide compression of tobacco material which passes therethrough. The apparatus includes roller 10 which is a common roller to each of the first and second pressurized roller systems. The first roller system includes roller 10 and another roller 20 in roll contact with one another. By the term "roll contact" is meant that the rollers each contact at a tangential point of the periphery of each roller; and such contact extends substantially along the length of each roller. Each of the rollers forming the first pressurized roller system are mounted such that the aforementioned roll contact of roller 10 with roller 20 is substantially maintained during the process of the invention. Force is applied to each of roller 10 and roller 20 by compression rollers in roll contact with each of rollers 10 and 20, such as compression roller 11 and compression roller 21, respectively. The force is provided in a direction shown schematically by arrow 12 and arrow 22, respectively. The force can be provided to rollers 11 and 21 by force providing means 13 and force providing means 23, respectively, such as jack screws or hydraulic cylinders (shown in FIG. 1). Preferably, two compression rollers are positioned on each roller of the pressurized roller system and are positioned towards the end of the roller with which the compression rollers are in roll contact (as shown in FIG. 2). Typically, each of the two such compression rollers have diameters and a combined longitudinal length less than that of the roller with which the compression rollers are in roll contact. The force providing means is positioned on each compression roller. Alternatively, the force providing means can be compression springs, tension springs, or the like. Each of rollers 10 and 20 are rotated in the direction indicated by the arrows within the rollers. The rollers are rotated in opposite directions relative to one another in order that the tobacco material can be passed through the nip of the rollers. Each of the rollers can be driven using a power source 26 (shown in FIG. 2) such as a variable speed motor (e.g. an electric motor having from about 1 to about 5 horsepower) which turns the rollers by a series of drive gears (not shown). The rollers are supported by support means such as a frame (not shown) to a chassis (not shown).

The second pressurized roller system includes roller 10 and another roller 30 in roll contact with one another. Each of the rollers forming the second pressurized roller system are mounted such that the aforementioned roll contact of roller 10 with roller 30 is substantially maintained during the process of this invention. Force is applied to each of roller 10 and roller 30 by compression rollers in roll contact with each of rollers 10 and 30, such as compression roller 11 and compression roller 31, respectively. The force is provided in a direction shown schematically by arrow 12 and arrow 32, respectively. The force can be provided to rollers 11 and 31 by force providing means 13 and force providing means 33, respectively, such as jack screws or hydraulic cylinders. Compression roller 31 and force providing means 33 are positioned as are the compression rollers and force providing means described hereinbefore. Alternatively, the force providing means can be compression springs, tension springs, or the like. Each of rollers 10 and 30 are rotated in the direction indicated by the arrows within the rollers. The rollers are rotated in opposite directions relative to one another in order that the tobacco material can be passed through the nip of the rollers. Each of the rollers can be driven using a power source 26 (shown in FIG. 2) which turns the rollers by a series of drive gears (not shown). The rollers are supported by support means such as a frame (not shown) to a chassis (not shown).

Rollers positioned relative to one another in the configuration shown in FIG. 1 form angle A which can be defined as that angle formed by the roll axis (i.e., the longitudinally extending axis) of each of rollers 20, 10 and 30, respectively. The value of angle A can depend upon a variety of factors including the diameters of the various rollers. Typically, angle A ranges from less than 180° to a limiting angle defined by the diameter of the rollers, and preferably ranges from about 90° to about 150°.

In the preferred embodiment shown in FIGS. 1 and 2, roller 10 contains the series of grooves extending longitudinally along the roller wherein each groove extends about the periphery of the roller, and rollers 20 and 30 (which are each in roll contact with roller 10) have substantially smooth (i.e., non grooved) roller faces. Alternatively, in another embodiment, rollers 20 and 30 each can have the previously described series of grooves extending longitudinally therealong, and roller 10 (which is in roll contact with each of rollers 20 and 30) can have a substantially smooth roller face.

When compression rollers are employed at each end of the roller system rollers in order to provide the required nip zone pressures to the roller systems, it is most preferable that the roller having the series of grooves extending longitudinally therealong have those grooves positioned along the longitudinal length of the roller in the region between the compression rollers and in the region not in roll contact with the compression rollers.

The forces between the rollers which typically are required in the process of this invention can vary, but are those forces which are great enough to generate sufficient roller nip zone pressures in order to provide ultimately reclaimed (i.e., reconstituted) tobacco materials in a strand form or in a sheet-like form. That is, sufficient nip zone pressures are those sufficient to provide shearing, mixing, and forming of said tobacco material, and can be as great as is desired. Typically, forces between rollers of at least about 3,000, and as great as about 10,000, preferably about 4,000 to about 6,000 pounds per linear inch, are great enough to generate sufficient roller nip zone pressures. Typically, the rollers are constructed of a metal material such as hardened carbon steel or hardened alloy steel. The sizes of the various rollers can vary. Typically, roller diameters range from about 3 inches to about 8 inches, preferably about 6 inches to about 8 inches; while roller lengths range from about 6 inches to about 12 inches, preferably about 8 inches to about 12 inches. Rollers forming the two roller systems can each have diameters which are equal, or the diameters of the various rollers can differ. Rotational roller speeds range, for example, from about 4 rpm to about 20 rpm.

In the process of this invention, tobacco material 40 which preferably has been physically premixed using conventional means, is fed by hopper 42 (which is shown as partially cut away in FIG. 2) to feed zone 44 which feeds the tobacco material to the nip of rollers 10 and 20. The tobacco material can vary and typically includes tobacco dust, tobacco fines, scrap tobacco which is recovered from various processing stages and cigarette manufacture stages, scraps and/or sheets of wet formed reconstituted tobacco (for example in dry form), scraps and/or sheets of dry formed reconstituted tobacco, tobacco leaf stems, and tobacco stems and stalks. Various types of tobaccos and blends thereof can be employed.

The structural strength providing amount of tobacco leaf stem material included in the tobacco material can vary, and depends upon a variety of factors including the amount and size of that leaf stem material which has a length and/or diameter greater than the width and depth of the roller grooves of the first roller system. For example, the amount of leaf stem material is not so high as to provide an undesirable character such as undesirable taste characteristics to the resulting strand material. However, the amount of leaf stem material is at least that amount which is of a size that is capable of providing a desirable structural strength to the reclaimed tobacco material formed according to this invention. For most practical purposes, the amount of leaf stem material required is at least about 15 percent, preferably at least about 18 percent, based on the total weight of tobacco material which is employed. Typically, the amount of leaf stem material does not exceed about 60 percent, based on the total weight of tobacco material which is employed. The tobacco leaf stem material can be employed as is without further grinding, milling, pulping, treating with large amount of water, etc. The character of the tobacco leaf stem material is such that said stem material can provide a structural strength to the resulting reclaimed tobacco material. For example, the stem material can provide a fibrous character to the resulting strand of reclaimed tobacco material. It is believed that the average size of the tobacco leaf stem material is an important factor in providing a reclaimed tobacco material of desirable structural strength. The average size of the tobacco leaf stem material can vary, but the length and/or diameter thereof is larger than the greatest width and depth of the grooves which extend about the periphery of the face of the first pressurized roller system. Typically, the average size of the tobacco leaf stem material which is employed in the process of this invention ranges from about 0.03 inch to about 0.2 inch in diameter, preferably from about 0.04 inch to about 0.13 inch in diameter. Typical tobacco leaf stem material which is employed ranges in length from about 0.25 inch to about 4 inches, preferably from about 0.375 inch to about 2 inches.

The moisture content of the tobacco material which is employed can vary. Typically, a low amount of moisture content requires a relatively greater amount of force between rollers in order to provide reclaimed tobacco materials; while a high moisture content requires the undesirable and energy intensive drying processes attendant in conventional water based reconstituted tobacco processes. Typically, the tobacco material which is employed in the process of this invention exhibits a moisture content of at least about 14 weight percent, preferably at least about 15 weight percent; while the upper limit of the moisture content is less than about 30 weight percent, and typically is as great as about 25 weight percent, preferably as great as about 18 weight percent. It is believed that moisture imparts a softening of tobacco material as well as providing a material having a pliability sufficiently low to allow for the utilization of a desirable force during the mixing process. It is desirable that the moisture content not be overly high as to cause an undesirable pliability of fiber material of relatively poor tensile strength.

The mixed and pre-formed tobacco material 46 which passes through and leaves the first pressurized roller system is fed into zone 48 which is a region capable of feeding the tobacco material to the second roller system. The tobacco material exiting the first roller system can have a tendency to stick to the rollers, and the material can be removed from the rollers (particularly roller 20 as shown in FIGS. 1 and 2) by scrape 50. Scrape 50 can be a series of needles, a comb-like configuration or a knife-like means such as a doctor blade positioned against the length of the face of the roller so as to remove (i.e., scrape) the tobacco material from the face of the roller. Most preferably, scrape 50 is positioned non-tangentially to the surface of the roller. For example, for the preferred embodiment illustrated in FIG. 1, scrape 50 is positioned against the face of roller 20 about 10° to about 45° along the surface of the roller relative to the center of the roller from the point at which rollers 10 and 20 meet in roll contact. Preferably, the scrape is positioned substantially parallel (i.e., within an angle of about 15°) relative to the tangent of the rollers formed by the point of the roll contact of rollers 10 and 20. Scrape 50 is attached to the chassis or frame of the apparatus (not shown) in order to maintain the positioning thereof against the face of the roller. If desired, zone 48 can be employed as an auxiliary feed zone where tobacco material, particularly small particle size material such as tobacco dust and/or tobacco fines, can be added to the mixed and pre-formed tobacco material 46 exiting the first roller system into zone 48. In particular, the compressed, admixed tobacco material provided by passing the tobacco material through the first pressurized roller system is contacted with tobacco dust and/or tobacco fines in zone 48. Zone 48 can include a means 52 for directing tobacco material 46 in the second pressurized roller system. The tobacco material 46 in zone 48 which has been mixed and pre-formed under pressure in the first pressurized roller system is generally a macerated, ground or pressed tobacco material having some reconstituted tobacco character.

Tobacco material 46 is further formed under pressure into the desired strand or sheet-like material by passing tobacco material 46 through a subsequent second pressurized roller system In the preferred embodiment shown in FIGS. 1 and 2, roller 10 has the previously described series of grooves extending longitudinally therealong and is in roll contact with both of rollers 20 and 30. Thus, tobacco material 46 is passed through the nip of rollers 10 and 30. The tobacco material 54 exits the second roller system and can be removed from the surface of roller 10 using scrape 56. Scrape 56 is attached to the chassis or frame of the apparatus (not shown) in order to maintain the positioning thereof against the face of the roller. The tobacco material 54 can be directed from the apparatus by removal means 58 and then collected.

Reconstituted tobacco material in strand form is provided through the use of scrape 56 having the form of needles 60 extending into each of the grooves of that roller having the series of grooves extending therealong (as shown in FIG. 2). For example, needles positioned so as to extend into the groove can tend to remove the tobacco material from the groove. Needles 60 are held in place by frame 62 (as shown in FIG. 2). Alternatively, reconstituted tobacco material in sheet-like form is provided through the use of scrape 56 having the form of a doctor blade (not shown) positioned as are needles 60 extending along the face of the roller having the series of grooves extending therealong.

Scrape 56 is most preferably positioned non-tangentially to the roller. For example, for the preferred embodiment illustrated in FIG. 1, scrape 56 is positioned against the face of roller 10 about 10° to about 30° along the surface of the roller relative to the center of the roller from the point at which rollers 10 and 30 meet in roll contact. Preferably, the scrape is positioned substantially parallel (i.e., within an angle of about 15°) relative to the tangent of the rollers formed by the roll contact of rollers 10 and 30.

Figure 3:
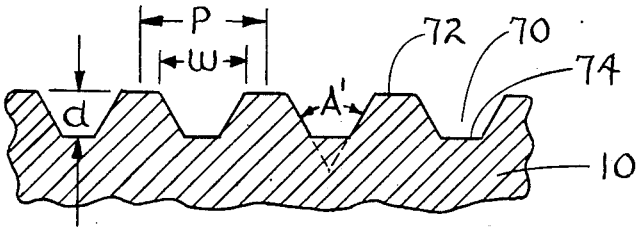
FIG. 3 is an enlarged, partial sectional view of of a roller taken along line 3—3 in FIG. 1 and showing a series of grooves extending circumferentially about the periphery of the roller.

FIG. 3 illustrates a series of grooves 70 each having a top portion 72 and a bottom portion 74. The series of grooves extend longitudinally along a portion of a roller designated as roller 10. The grooves 70 can be incorporated into roller 10 by techniques such as machining using a suitable lathe. Each groove completely circumscribes roller 10. Preferably each groove has a shape substantially similar to the other grooves which extend along the roller. The grooves can extend about the roller in a radial fashion, a helical fashion, or the like. Preferably, the grooves circumscribe the roller substantially transversely relative to the longitudinal axis of the roller. Top portion 72 can be, for example, pointed, or flattened (as illustrated in FIG. 3). When flattened, the top portion 72 typically ranges in width from about 0.010 inch to about 0.015 inch. Generally, the flattened top portion 72 is narrow enough so as to not require excessive force in order to maintain roller contact in the pressurized roller system; while flattened top portion 72 is wide enough as to not deform to a substantial extent under typical roller pressures. Bottom portion 74 can be pointed, rounded, or flattened (as illustrated in FIG. 3). When flattened, bottom portion 74 typically ranges in width from about 0.003 inch to about 0.007 inch. Generally, bottom portion 74 is narrow enough so as to provide sufficient mixing action of the tobacco material. The mixing action is believed to be provided by the compression feeding performed by the relatively large size leaf stems which carry the tobacco particles into the grooves. Flattened bottom portion 74 is wide enough so as to permit the release of tobacco material from the surface region of the roller after processing. In particular, a bottom portion 74 which is overly narrow or pointed can tend to trap tobacco material in the groove and prevent release of the tobacco material therefrom. The depth d of the groove can vary and typically ranges from about 0.015 inch to about 0.035 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of tobacco material which is processed, the moisture content of said tobacco material, the leaf stem content of the tobacco material, the shape of the groove, and the like. The pitch is defined as that lateral distance from the the center of top portion 72 to the center of the nearest adjacent top portion 72. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 70 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A′ of less than about 100°, can mix tobacco material suitably well; and a pressurized roller system having a roller comprising a series of grooves each having a sloping inner edge, each groove circumscribing an angle A′ of greater than about 45°, can release processed tobacco material suitably well. The preferred angle A′ is about 60° to about 90°, most preferably about 60°.

The process of this invention employs first and second roller systems each having a grooved roller as described previously. It is believed that the shearing action provided by each pressurized roller system provides a breakdown of individual particles and fibers of tobacco material. Such a breakdown of particles and fibers is believed to provide a separation of natural binding materials from the particles and fibers, which natural binding materials can provide a binding action to the tobacco material in order to provide a resulting strand material. In addition, it is believed that shearing and mixing action provided by the pressurized roller system can provide a sufficient mechanical interlocking of fibers and particles, thus forming a type of matrix. Thus, a pressurized roller system containing a roller having a series of grooves having a size smaller than that of the tobacco leaf stem material is believed to provide a separation of leaf stem material, mixing and remixing of tobacco material, coalescing and agglomeration of tobacco material, and binding of tobacco material with natural binding materials of tobacco material.

The reclaimed tobacco which is provided according to the process of this invention can be provided generally in the form of a strand. Typically, the tobacco material in the form of a strand exhibits a structural strength which approaches that of cut filler. By the term "strand" as used herein is meant that the tobacco material is in a form wherein the length of said material is substantially greater than the width and thickness thereof. Typically, the thickness of the strand approximates that of tobacco leaf. For example, the thickness of the strand ranges from about 0.005 inch to about 0.040 inch, preferably from about 0.025 inch to about 0.035 inch. The length of the strand can vary depending upon the means which is employed in forming the strand. The width can vary and typically approximates that of cut filler (i.e., most preferably about 32 cuts per inch). The thickness and width of the strand is most dependent upon the dimensions of the grooves of the rollers. The strand can be cut into lengths and employed as filler in the manufacture of cigarettes.

The reclaimed tobacco which is provided according to the process of this invention can be provided generally in the form of a sheet. Typically, the tobacco material in the form of a sheet exhibits a structural strength which approaches that of tobacco leaf. By the term "sheet" as used herein is meant that the tobacco material is in a form wherein the length and width thereof are substantially greater than the thickness thereof. Typically, the thickness of the sheet approximates that of tobacco leaf. For example, the thickness of the sheet ranges from about 0.005 inch to about 0.040 inch, preferably from about 0.005 inch to about 0.015 inch. The length and width of the sheet can vary. The width of the sheet generally is determined by the length of the means for removing the reclaimed tobacco material from the roller face having the series of grooves of the second roller system. The sheet can be cut as in tobacco leaf or wet formed reconstituted tobacco material (e.g., in strips of about 32 cuts per inch) and employed as cut filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

An apparatus which is generally described in FIGS. 1, 2 and 3 is provided. Roller 20 is constructed of hardened carbon steel, has a substantially smooth surface, and has a diameter of 5 inches and a roller face having a length of 8 inches. Roller 10 has a diameter of 5 inches and is of similar length and construction to roller 20; however, roller 10 contains grooves extending in a radial fashion about the periphery of said roller 10. Roller 10 comprises grooves in a 5 inch distance along the roller face, and the 1.5 inch distance along the roller face at each end of the roller is relatively smooth. Roller 10 is generally described in FIG. 3. The depth d of the grooves is about 0.0155 inch, the pitch p of each groove is about 0.03125 inch, and the angle A′ is about 60°. The top portion of each groove is flattened by a distance of about 0.01275 inch, and the bottom of each groove is flattened by a distance of about 0.006 inch. The rollers are operated using variable speed drive using a variable speed 1.5 horsepower electric motor at a speed of about 4 rpm, and a nip zone pressure of about 5000 pounds per linear inch is generated. Roller 30 is of similar size and construction to roller 20. Roller 30 is operated using a variable speed drive at a speed of 4 rpm, and nip zone pressure between each of roller 10 and roller 30 of 5000 pounds per linear inch is generated. The angle A provided by the central axis of roller 20, roller 10 and roller 30, respectively, is 90°. Scrape 56 in the form of needles is positioned so as to remove the reclaimed tobacco material from roller 10. Force is provided to each of rollers 10, 20 and 30 by 2 compression rollers positioned in roll contact with each of rollers 10, 20, and 30. Each compression roller is positioned at one end of each of rollers 10, 20 and 30. The compression rollers are about 1 inch in longitudinal length and about 2 inches in diameter. Force is provided to the compression rollers by jack screws.

A blend of scrap tobacco is provided. The blend is about 45 percent cut tobacco filler fines having an average particle diameter of less than 20 Tyler mesh, about 17 percent tobacco dust from a Molins MK9 Maker, and about 38 percent Winnower throw stems from a Molins MK9 Maker. The blend exhibits a moisture content of about 10 percent. A resultant blend is provided by contacting the blend with enough water to provide a blend exhibiting a 20 percent moisture level. The resultant blend is introduced into the apparatus and a reclaimed tobacco material in the form of strand is provided. The resulting strand has a generally triangular or trapezoidal shape and dimensions of about 1 inch long, about 0.024 inch thick, about 0.012 inch to about 0.025 inch wide.

EXAMPLE 2

An apparatus which is generally described in FIGS. 1, 2 and 3 is provided. Each of rollers 10, 20 and 30 have a diameter of about 4 inches and are constructed from harded carbon steel. The rollers each have a longitudinal length of about 4 inches. Each of rollers 20 and 30 have substantially smooth roller faces. Roller 10 has a roller face having a series of grooves extending about 2 inches along the longitudinal length of the roller and positioned on the roller such that roller face is substantially smooth near the ends of the roller. Each groove on roller 10 extends in a radial fashion about the periphery of the roller and is generally described in FIG. 3. The depth d of each groove is about 0.017 inch; the width of each groove is about 0.025 inch; the pitch p of each groove is about 0.036 inch; and the angle A′ is about 60°. Each of rollers 20 and 30 are in roll contact with roller 10 and angle A provided by the central axis of roller 20, roller 10 and roller 30, respectively, is 150°. At both ends of each roller and in roll contact with each roller are positioned compression rollers. Each compression roller has a longitudinal length of 1 inch and a diameter of 2 inches. Hydraulic cylinders connected to both compression rollers 11, and jack screws connected to compression rollers 21 and 31, provide nip zone pressures to each of the pressurized roller systems of greater than about 3000 pounds per linear inch. The apparatus is powered by 1 horsepower variable speed electric motor. The grooves of the roller 10 are positioned with removal means 56 in the form of needles.

A blend of scrap tobacco as described in Example 1 is processed using the apparatus, and reconstituted tobacco in the form of strand is provided.

What is claimed is:

1. A process for reclaiming tobacco, said process comprising the steps in combination (a) providing tobacco material including tobacco leaf stem material, the tobacco material having a moisture content less than about 30 weight percent, and then (b) passing said tobacco material through the nip of a first pressurized roller system having two rollers exhibiting a nip zone pressure sufficient to provide compression of said tobacco material thereby providing compressed, admixed tobacco material, wherein at least one of the roller faces comprises a series of grooves extending along the longitudinal axis of the roller and each groove extends about the periphery of said roller, wherein each groove has a maximum width near the surface of the roller and a minimum width near the bottom of the groove, wherein each of said grooves has a maximum width and depth which are smaller than the length and/or diameter of tobacco leaf stem material, and wherein the tobacco leaf stem material is employed in a structural strength providing amount, and then (c) forming under pressure reclaimed tobacco material by passing said compressed, admixed tobacco material through the nip of a second pressurized roller system having two rollers exhibiting a nip zone pressure sufficient to provide the reclaimed tobacco material, wherein at least one of the roller faces of the rollers comprises a series of grooves extending along the longitudinal axis of the roller and each groove extends about the periphery of said roller, wherein each groove has a maximum width near the surface of the roller and a minimum width near the bottom of the groove, and wherein each of the grooves has a maximum width and depth sufficient to provide reclaimed material, and then (d) removing the reclaimed tobacco material from the face of the roller comprising the series of grooves of the second pressurized roller system.

2. The process of claim 1 wherein said tobacco material is provided in the absence of a binder.

3. The process of claim 1 wherein the amount of said tobacco leaf stem material in said tobacco material is at least about 15 percent, based on the total weight of said tobacco material.

4. The process of claim 1 wherein said nip zone pressure is at least about 3,000 pounds per linear inch.

5. The process of claim 1 wherein said tobacco material which is provided in step (a) includes scraps and/or sheets of wet formed reconstituted tobacco.

6. The process of claim 1 wherein the tobacco material exhibits a moisture content between about 15 weight percent and about 18 weight percent.

7. The process of claim 1 wherein the tobacco material exhibits a moisture content between about 14 weight percent and about 25 weight percent.

8. The process of claim 1 wherein the amount of said structural strength providing amount of leaf stem material ranges from about 15 to about 18 percent based on the total weight of tobacco material which is employed.

9. The process of claim 8 wherein said structural strength providing amount of tobacco leaf stem material ranges from about 0.03 inch to about 0.2 inch in diameter, and from about 0.25 inch to about 4 inches in length.

10. The process of claim 1 wherein said tobacco leaf stem material is not pre-ground.

11. The process of claim 1 wherein each of said grooves is generally "V" shaped.

12. The process of claim 1 wherein said reclaimed tobacco material is removed by a series of needles positioned in the grooves of the roller.

13. The process of claim 1 wherein said reclaimed tobacco material is removed by a blade positioned along the length of the roller having the series of grooves.

14. The process of claim 12 wherein said reclaimed tobacco material is in strand form.

15. The process of claim 13 wherein the reclaimed tobacco material is in sheet-like form.

16. The process of claim 1 wherein the compressed admixed tobacco material provided by passing the tobacco material through the first pressurized roller system is contacted with tobacco dust and/or tobacco fines prior to passing the compressed, admixed material through the second pressurized roller system.

17. The process of claim 1 wherein each of said grooves circumscribe the roller substantially transversely relative to the longitudinal axis of the roller.

18. An apparatus for providing reclaimed tobacco, the apparatus comprising:

(a) a first pressurized roller system wherein at least one of the roller faces thereof comprises a series of grooves extending along the longitudinal axis of the roller wherein each groove extends about the periphery of the roller, and wherein each groove has a maximum width near the surface of the roller and a minimum width near the bottom of the groove, (b) a second pressurized roller system wherein at least one of the roller faces thereof comprises a series of grooves extending along the longitudinal axis of the roller wherein each groove extends about the periphery of the roller, and wherein each groove has a maximum width near the surface of the roller and a minimum width near the bottom of the groove, and (c) a means for removing reclaimed tobacco material from the roller face having the series of grooves thereby providing reclaimed tobacco which is provided by the second roller system.

19. The apparatus of claim 18 wherein each groove has a depth which ranges from about 0.015 inch to about 0.035 inch.

20. The apparatus of claim 18 wherein each groove has a greatest width which ranges from about 0.015 inch to about 0.040 inch.

21. The apparatus of claim 18 wherein each groove has a flattened or rounded bottom.

22. The apparatus of claim 18 wherein each groove circumscribes the roller substantially transversely relative to the longitudinal axis of the roller.

23. The apparatus of claim 18 wherein a roller of the first roller system is a common roller second roller system.

24. The apparatus of claim 23 having a total of 3 rollers forming the first and second roller systems wherein the angle defined by the roll axis of each of the rollers ranges from about 90° to about 150°.

25. The apparatus of claim 24 wherein the roller common to each of the first and second roller systems comprises the series of grooves.

26. The apparatus of claim 25 wherein each groove circumscribes the roller substantially transversely relative to the longitudinal axis of the roller.

27. The apparatus of claim 25 having a total of 3 rollers forming the first and second roller systems wherein each of the rollers common to the roller comprising the series of grooves have substantially smooth surfaces.

* * * * *